United States Patent [19]

Tolley

[11] Patent Number: 4,525,884

[45] Date of Patent: Jul. 2, 1985

[54] SUN BEDS

[76] Inventor: Derek C. Tolley, Eisteddfa Farm, Llannon, Llanelli, Dyfed, Wales

[21] Appl. No.: 404,566

[22] Filed: Aug. 2, 1982

[51] Int. Cl.[3] ..... A47C 27/08; A47C 29/00

[52] U.S. Cl. ..... 5/423; 5/284; 5/421; 5/60; 128/376

[58] Field of Search ..... 5/1, 60, 82 R, 284, 5/421, 423, 451; 128/376, 377, 372, 373; 126/417, 450

[56] References Cited

U.S. PATENT DOCUMENTS

| | | | |
|---|---|---|---|
| 977,828 | 12/1910 | Ohmstede | 5/284 |
| 2,653,612 | 9/1953 | Hooe | 128/372 |
| 2,676,596 | 4/1954 | Rait | 128/373 |
| 2,698,017 | 12/1954 | Hakonsson | 128/372 |
| 4,212,288 | 7/1980 | Lipinski | 126/450 |
| 4,265,398 | 1/1981 | Poisson | 126/450 |
| 4,320,744 | 3/1982 | Fodor et al. | 126/417 |

FOREIGN PATENT DOCUMENTS

| | | | |
|---|---|---|---|
| 51257 | 6/1978 | Japan | 126/450 |

*Primary Examiner*—Gary L. Smith
*Assistant Examiner*—Michael F. Trettel
*Attorney, Agent, or Firm*—Young & Thompson

[57] ABSTRACT

This invention relates to sun beds. In the described embodiment the bed has an elongate base (1) which is generally flat but has a rim (2) of inverted U-form. The base (1) is covered by a dome (4). The base (1) has a frame with a plurality of vents (11), while the dome has a vent formed in a blister (9). The vents are positioned such that solar action generates convection currents which will draw air in through the base vents as hot air escapes through the dome vent.

8 Claims, 4 Drawing Figures

SUN BEDS

This invention relates to sun beds.

In this country it is sometimes possible to sunbathe outside, but for regular treatment the tendency is to rely on indoor installations using electrically powered sun lamps. These have their dangers and, of course, expense.

It is the aim of this invention to provide sun beds for use outside, which can take advantage of the natural rays of the sun throughout the year.

According to the present invention there is provided a sun bed comprising a base and a clear plastics dome which is closable over said base, the dome having a vent adjustable from the interior at or near its highest point, and the base having venting at its periphery, whereby solar action generates convection currents within the dome which draws air in through the base venting as hotter air escapes through the dome vent.

For efficient weather-proofing the dome vent may be on a protruding blister.

The dome is preferably made of a clear acrylic plastics reinforced around its base by a tubular frame. The dome may be overblown so that it slightly overhangs the frame and base, giving more room and a sense of freedom for the occupant. The frame may be used to secure part of a hinge by which the dome can be attached to the base.

The base is conveniently a generally flat plastics moulding with an inverted U-shaped rim. The outer flange of this rim may be clear of the ground and its upper portion facing into the dome may be formed with slots providing the venting. Thus air can enter the dome from substantially all around the base via the inverted U-channel and those slots.

For a single occupant the dome and base will be elongated, with the dome larger and higher at the head end. It will be possible to have larger versions for two or more people.

The occupant may lie on a mattress on the base and this may be canted up at one end to form an inclined back and head rest.

In order to conserve heat in the colder months, a black water bed may be preferred, since this will absorb and conserve a great deal of solar energy while the bed is not in use, and keep the interior at a comfortable temperature even during periods of no sun.

For a better understanding of the invention one embodiment will now be described, by way of example, with reference to the accompanying drawing, in which.

Figure 1:
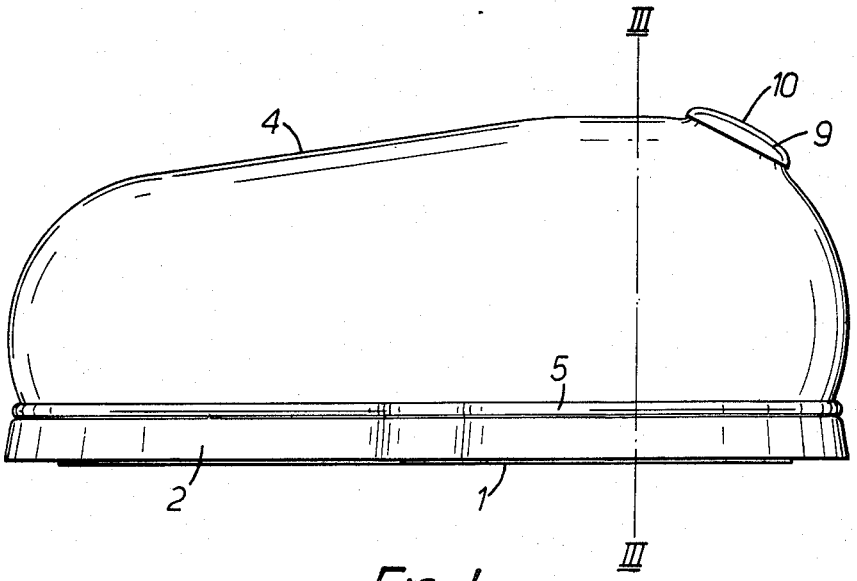
FIG. 1 is a side view of a sun bed.
Figure 2:
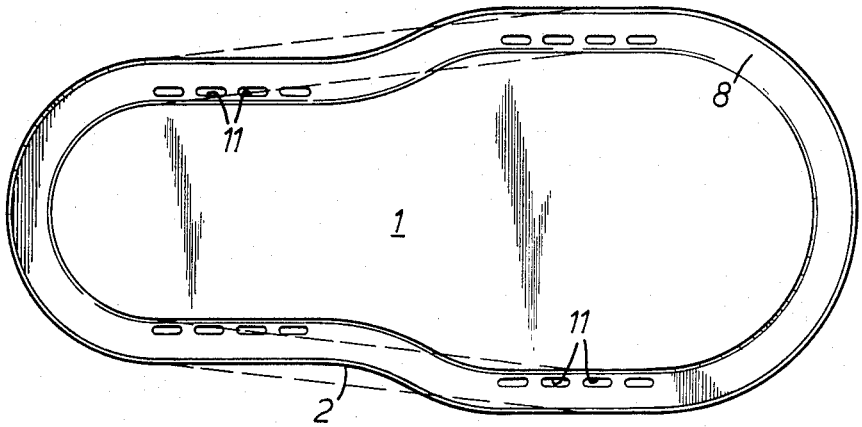
FIG. 2 is a plan view of the base of the bed of FIG. 1.
Figure 3:
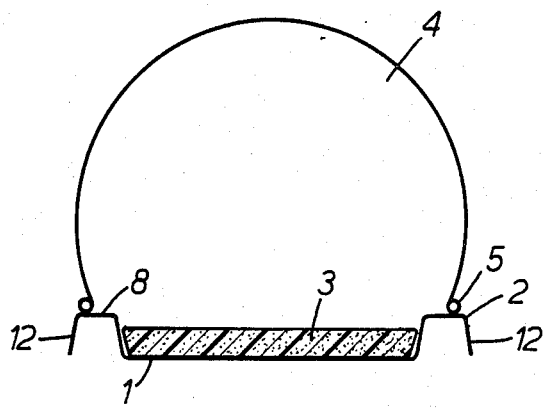
FIG. 3 is a section on the line III—III of FIG. 1.

The bed has a base 1 which is generally flat but with a rim 2 of inverted U-form. In plan it is elongate, with rounded ends and with one end portion (for the head) being slightly wider than the other. Instead of these end portions having a recognisable transition with a shoulder, the sides may be straight throughout but divergent from the narrow end as indicated by the broken line. The base can be moulded in plastics or be a metal pressing, and the shallow tray formation thus provided can be used to locate a mattress 3 (FIG. 3).

Figure 4:
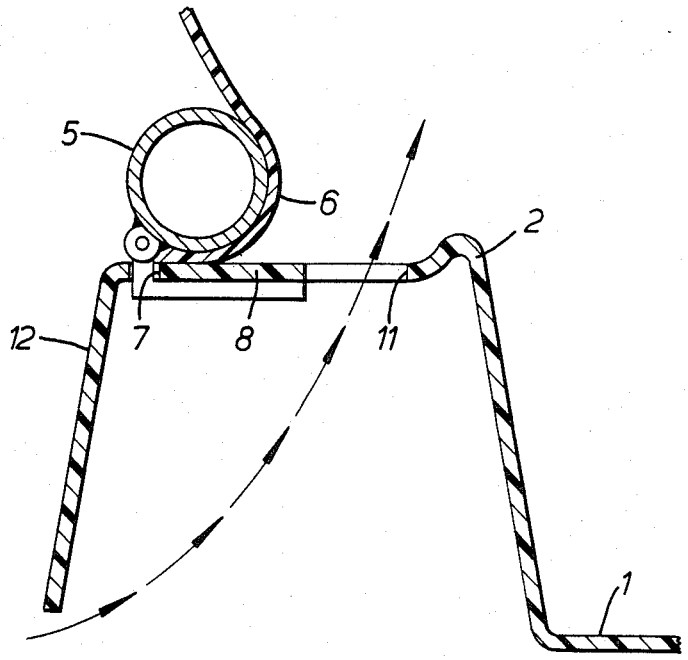
FIG. 4 is a detail showing a hinge.

This base 1 is covered by a dome 4 of clear acrylic plastics material. Such material is known which has 95% permeability to the sun's radiation. The dome is reinforced around its base by a tubular frame 5, its rim portion 6 bending around, inside and under this frame. The dome is formed by a blowing process and it is distended to overhang the frame slightly, which is therefore made captive. The frame 5 follows the plan contour of the base and is used as shown in FIG. 4 as a means by which the dome is hinged to the base, the other part of the hinge being entered through a slot 7 and secured to the underside of the flat top 8 of the rim 2.

The dome 4 is formed somewhat higher and wider at the head end and it is here provided, near its highest point, with a blister 9 which forms a base for a vent. The blister has a number of apertures and a clear vent cap 10 in the same plastics material shields it on the outside. However the cap 10 can be moved by the occupant from inside the dome to control the amount of closure of those apertures.

The flat top 8 of the rim 2 is formed with series of slots 11 which remain open to the inside of the dome when the latter is closed onto the outer edge portion of that top 8. The outer flange 12 of the rim 2 does not extend right down to the plane of the main portion of the base and so will be just clear of the ground. Thus air can enter under that flange into the inverted U-channel and thence via the slots 11 into the dome, as indicated by the arrowed line in FIG. 4.

In use, the action of the sun will rapidly heat up the air inside the dome, and the occupant can open the vent cap 10 to allow it to escape by convection. This draws in further air via the slots 11 and a continual flow is maintained. The rate of this can be governed by the occupant to maintain a comfortable temperature. The occupant has only the highly permeable clear plastics material between him or herself and the sun, and any feeling of claustrophobia is unlikely.

I claim:

1. A sun bed comprising a clear plastic dome with venting means adjustable from the interior in the region of its highest point, and a generally flat base with an upstanding rim on which the dome seats when closed over the base, the rim being of inverted U-section with an outer flange that is clear of the ground and a top portion, from which that flange depends, provided with vents, the dome seats being around the outer periphery of that top portion, solar action generating convection currents which will draw air in through the vents and out through the venting means.

2. A sun bed as claimed in claim 1, wherein the venting means is on a protruding blister.

3. A sun bed as claimed in claim 1, wherein the dome is over blown, with a reinforcing frame around its rim.

4. A sun bed as claimed in claim 3, wherein the frame is used to hinge the dome to the base.

5. A sun bed as claimed in claim 1, wherein the dome and base are elongated and wherein the dome is larger and/ higher at one end than the other.

6. A sun bed as claimed in claim 1 further comprising a mattress on the base.

7. A sun bed as claimed in claim 6, wherein the mattress is canted up at one end to form an inclined back and head rest.

8. A sun bed as claimed in claim 6, wherein the mattress is a black water bladder.

* * * * *